US007161052B2

(12) United States Patent
Briot et al.

(10) Patent No.: US 7,161,052 B2
(45) Date of Patent: Jan. 9, 2007

(54) PROCESS FOR THE VALORIZATION OF A CHARGE OF HYDROCARBONS AND FOR REDUCING THE VAPOR PRESSURE OF SAID CHARGE

(75) Inventors: Patrick Briot, Pommier de Beaurepaire (FR); Vincent Coupard, Vaulx en Velin (FR); Alain Forestiere, Vernaison (FR); Eric Llido, Communay (FR); Thierry Poussereau, Lyons (FR)

(73) Assignee: Institut Francais de Petrole, Rueil Malmaison Cedex (FR)

( * ) Notice: Subject to any disclaimer, the term of this patent is extended or adjusted under 35 U.S.C. 154(b) by 554 days.

(21) Appl. No.: 10/653,426

(22) Filed: Sep. 3, 2003

(65) Prior Publication Data

US 2005/0101821 A1 May 12, 2005

(30) Foreign Application Priority Data

Sep. 4, 2002 (FR) ..... 02 10951

(51) Int. Cl.
*C07C 2/68* (2006.01)
*C07C 2/04* (2006.01)
*C07C 2/00* (2006.01)

(52) U.S. Cl. ..... 585/467; 585/458; 585/466; 585/709; 585/721; 585/730; 585/510; 585/514; 208/93

(58) Field of Classification Search ..... 585/458, 585/466, 467, 709, 721, 730, 510, 514; 208/93
See application file for complete search history.

(56) References Cited

U.S. PATENT DOCUMENTS 5,684,220 A * 11/1997 Johnson et al. ..... 585/332

* cited by examiner

*Primary Examiner*—Glenn Caidarola
*Assistant Examiner*—In Suk Bullock
(74) *Attorney, Agent, or Firm*—Millen, White, Zelano & Branigan, P.C.

(57) ABSTRACT

A process is described for the valorization of a charge of hydrocarbons and for reducing the vapour pressure of said charge, comprising three steps: a step a) consisting of separating said charge of hydrocarbons into a fraction (O1) comprising essentially compounds containing 5 carbon atoms, including at least 2% by weight of pentenes, a step b) consisting of placing said fraction (O1) in contact with a cut of hydrocarbons (O2) at least partly comprising hydrocarbons having a number of carbon atoms between 6 and 10, including at least 2% by weight of olefins, and a step c) consisting of separating the effluents originating from step b) into a gasoline cut (α) the upper distillation point of which is less than 100° C. and a kerosene cut (β) having a distillation range between 100° C. and 300° C.

20 Claims, 1 Drawing Sheet

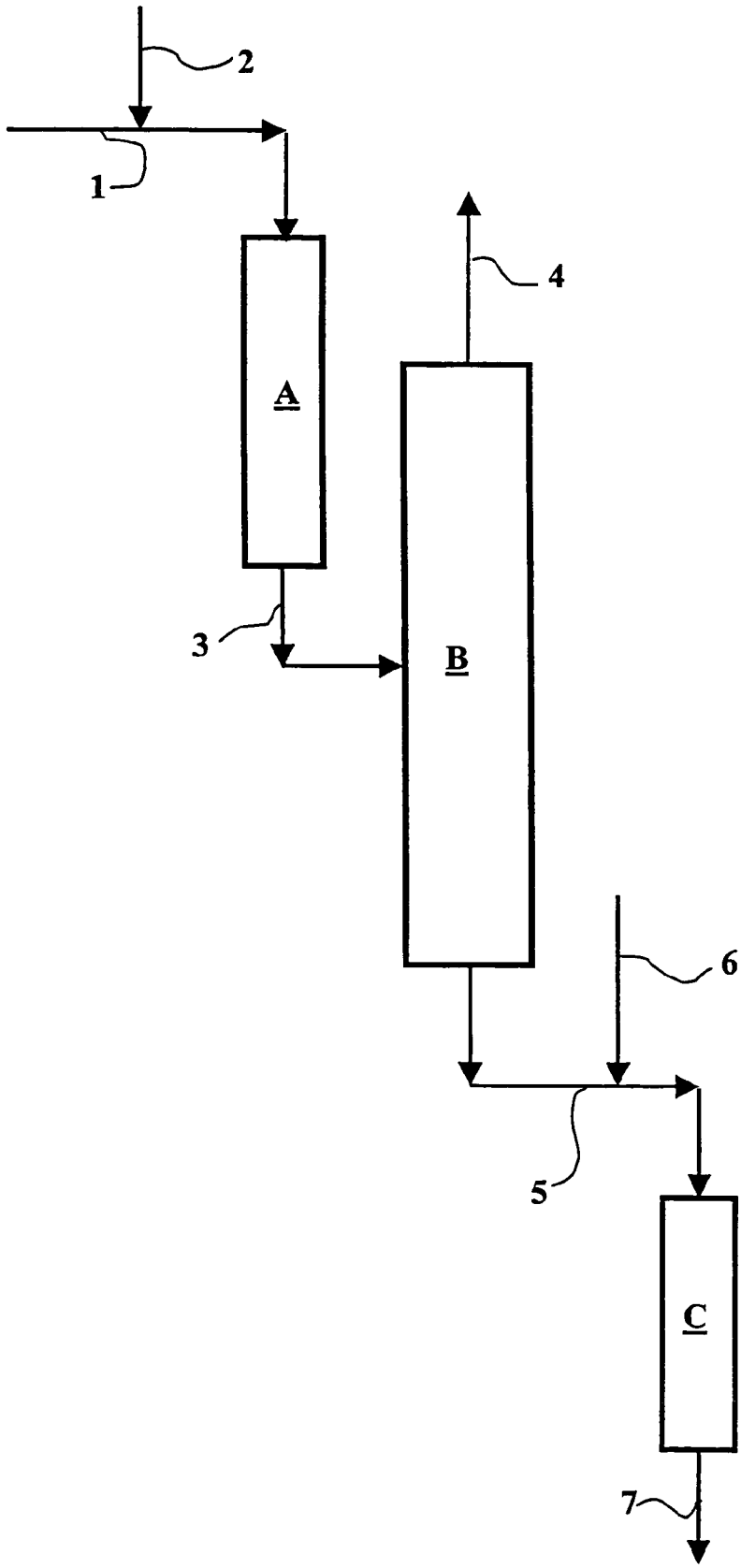
2
1
A
4
3
B
6
5
C
7

PROCESS FOR THE VALORIZATION OF A CHARGE OF HYDROCARBONS AND FOR REDUCING THE VAPOR PRESSURE OF SAID CHARGE

The present invention relates to a process for the valorization of a liquid charge of hydrocarbons, typically a gasoline cut. The process according to the present invention allows not only the valorization of said charge while reducing its vapor pressure but also the production of a synthetic kerosene having a high smoke point. Typically, the initial charge of hydrocarbons at least partly comprises a C5 cut, i.e. comprising mainly molecules containing 5 carbon atoms. Preferably, said liquid charge of hydrocarbons is a gasoline cut originating from a steam cracking, catalytic cracking (FCC) or coking process.

The greater part of the C5 fraction contained in the hydrocarbons is currently used directly as a gasoline base although it has a low octane rating. A known alternative allowing a better valorization of said cut is its use as a petrochemical intermediate. In this case, the C5 fraction is generally separated from the other hydrocarbons by a depentanizer. It therefore constitutes a major source of olefins and diolefins the uses of which are varied: resins, elastomers and specialty products. The estimated demand for this application will be approximately 1.5 Mt (millions of tonnes) in 2005. As a guide, the availability of C5 cut for the portion originating from steam cracking alone is approximately 5 Mt in 1995. It therefore seems that the petrochemical industry's C5 hydrocarbons needs are currently largely satisfied and the available excess must be used in gasolines, despite its low octane rating, as stated previously.

Thus the present invention proposes to provide an alternative process allowing the treatment and valorization of substantial and increasing quantities of said C5 cut. One of the subjects of the present invention is a new process of the valorization of such a cut in order to allow the treatment of much greater quantities of said cut than the previously described petrochemical processes.

Furthermore, within the framework of increasingly strict environmental specifications, it is very likely that the progressive reduction of the (Reid) vapor pressure of gasolines will be required by the laws of the industrialized countries in the coming years.

The present invention thus also proposes to provide a solution allowing the reduction of the Reid vapor pressure of a charge of liquid hydrocarbons, for example of gasolines, while proposing an alternative solution allowing the valorization of at least part, if not all of the C5 fraction with a low octane rating contained in these same hydrocarbons.

Most generally, the invention relates to a process for the valorization of a liquid charge of hydrocarbons, advantageously a gasoline cut, and for reducing the vapor pressure of said charge and comprising the following steps:

a) the separation from said charge of hydrocarbons of a fraction (O1) comprising essentially compounds containing 5 carbon atoms, including at least 2% by weight of pentenes, b) a placing of said fraction (O1) in contact with a cut of hydrocarbons (O2) at least partly comprising hydrocarbons having a number of carbon atoms between 6 and 10, including at least 2% by weight of olefins, in the presence of at least one catalyst promoting the reactions of dimerization and alkylation of the species present in the mixture resulting from said placing in contact, c) a separation of the effluents originating from step b) into at least two cuts:

a gasoline cut (α) the upper distillation point of which is less than 100° C. and 300° C. comprising most of the reagents that have not reacted and a kerosene cut (β) having a distillation range between 100° C. and 300° C. comprising most of the products originating from the alkylation and dimerization reactions.

By "essentially compounds containing 5 carbon atoms" is meant within the meaning of the present description that said fraction (O1) comprises at least 30% by weight of compounds containing 5 carbon atoms, preferably at least 50% by weight and very preferably at least 70% by weight of compounds containing 5 carbon atoms. When the separation of step a) is carried out by a depentanizer, said fraction can, without departing from the scope of the invention, contain quantities of C5 hydrocarbons greater than 90% by weight, preferably greater than 95% by weight and very preferably greater than 99% by weight. Preferably, said charge of hydrocarbons (O1) comprises at least 10% by weight of pentenes, preferably at least 30% by weight, and very preferably at least 50% by weight of pentenes.

The process according to the invention thus allows on the one hand the valorization of said charge of hydrocarbons, for example a gasoline cut, thanks to the separation, most often by distillation, of all or part of the C5 fraction contained therein, and on the other hand the obtention of a fuel for which the demand is growing: kerosene, by reaction of dimerization and alkylation of said C5 cut with a cut (O2) as previously described. Said cut (O2) advantageously originates from another refinery process, and is preferably chosen from the group constituted by gasolines originating from a catalytic cracking process (FCC), products originating from the oligomerization of ethylene, from the dehydrogenation of paraffins, from the dimerization and/or from the oligomerization of butenes and propenes such as the Dimersol® process (see also Hydrocarbon Processing, Vol 89, pp 143–149, (1980) and Vol 91 pp 110–112 (1982)). In general, to promote a good yield of kerosene, a cut (O2) is chosen which comprises at least 30% by weight of hydrocarbons containing 6 to 10 carbon atoms, preferably at least 50% by weight of hydrocarbons containing 6 to 10 carbon atoms and very preferably at least 70% by weight of hydrocarbons containing 6 to 10 carbon atoms. It was found by the applicant that the properties of the kerosene cut (β) obtained and in particular its smoke point are all the more attractive the greater the quantity of olefins present in said cut of hydrocarbons (O2). Thus, and preferably, the charge of hydrocarbons (O2) comprises at least 10% by weight of olefins, preferably at least 30% by weight of olefins and very preferably at least 50% by weight of olefins. A considerable improvement of the smoke point of the kerosene produced and/or the elimination of any possible sulphur impurities contained in the kerosene cut is advantageously obtained by implementing an additional step d) which consists of hydrogenating the unsaturated compounds contained in the kerosene cut (β) originating from step c) of the process according to the invention.

It will be recalled that the smoke point is a standardized test which measures the maximum height of a flame not emitting smoke in an oil lamp (wick lamp). The smoke point is expressed in mm. The higher the smoke point, indicating a lower C/H ratio, the better the qualities of the kerosene.

According to a particular embodiment of the process according to the present invention, said cut (O2) is constituted exclusively by an olefin or a mixture of olefins, i.e. constituted by a pure olefin or a mixture of pure olefins.

According to another possible embodiment of the invention, the upper (final) distillation point of the gasoline cut (α) is less than 100° C. and the lower (initial) distillation point of the kerosene cut (β) is at least 100° C., preferably greater than 120° C. and very preferably greater than 150° C.

The composition of the C5 fraction can vary according to the origin of the process. It contains in particular cycloolefins such as cyclopentene the reactivity of which is limited. Said cyclopentene content varies according to the original process of the C5 cut. For example, for the C5 cut contained in the gasolines obtained by a catalytic cracking process in a fluidized bed (FCC), the cyclopentene content is of the order of 0.2% by weight. This content can reach 30 to 35% by weight in the case of the C5 fraction contained in a gasoline originating from a steam-cracking process. The following composition (by weight) is given by way of example representing such a fraction:

n-pentane: 13%
isopentane: 10%
cyclopentane: 4%
methylbutenes: 21%
n-pentenes: 16%
cyclopentene: 25.4%

The catalyst of the reactions of dimerization and alkylation of olefins is an acid catalyst as described for example in the U.S. Pat. No. 4,902,847. It is preferably chosen from the group constituted by silica, silica-aluminas, silico-aluminates, titano-silicates, silica-zircons, mixed alumina-titanium, zeolites, clays, ion exchange resins, mixed oxides obtained by grafting at least one organometallic compound soluble in organic and/or aqueous solvents (most often chosen from the group formed by the metal alkyls and/or the alkoxys of at least one element of the groups IVA, IVB, VA, such as titanium, zirconium, silicon, germanium, tin, tantalum, niobium) on at least one mineral oxide such as alumina (gamma, delta, alpha forms, alone or in mixture) and any other solid having any acidity. A particular version of the invention can consist of using a physical mixture of at least two catalysts such as those mentioned above in proportions varying from 95/5 to 5/95, preferably 85/15 to 15/85 and very preferably 70/30 to 30/70. There may also be used supported sulphuric acid or supported phosphoric acid. In this case the support is usually a mineral support such as for example one of those cited above and more particularly silica, alumina or a silica-alumina.

According to a variant of the process according to the present invention, steps b) and c) can be carried out simultaneously, for example using reactors placed in parallel or in a catalytic distillation column.

According to an advantageous embodiment of the invention, at least one fraction of at least one gasoline cut originating from step c) at least partly constitutes the cut of hydrocarbons (O2) from step b) of placing in contact.

Alternatively, the gasoline cuts originating from step c) can be used as gasoline base.

BRIEF DESCRIPTION OF DRAWING

The attached drawing is a box flowsheet of the embodiment described below.

The invention will be better understood on reading the embodiment which follows, it being understood that this is provided by way of illustration and that the present invention is not limited to this embodiment alone.

A C5 cut obtained by distillation of a gasoline originating from a steam-cracking process and as characterized previously is conveyed along line 1 towards a reaction unit A. A charge of hydrocarbons comprising at least 2% by weight of olefins the number of carbon atoms of which is between 6 and 10 is mixed with the C5 cut thanks to line 2. According to an advantageous version of the invention, the molar ratio between the olefins contained in the C5 cut and the olefins contained in the charge (O2) is between 0.01 and 100, preferably between 0.1 and 10.

The mixture of the two charges is passed into unit A containing an acid catalyst of the joint reactions of dimerization and alkylation of said olefins (step a). The catalyst can be any one of those mentioned previously. Said catalyst is advantageously chosen from the ion exchange resins, the silica-aluminas, zeolites, clays, supported sulphuric acid and supported phosphoric acid. In general, this can be any silico-aluminate having any acidity, optionally added by the absorption of acids on this support. The volume velocity per hour, i.e. the volume of charge injected per hour over the volume of catalyst is approximately 0.1 to approximately 10 $h^{-1}$ (liter/liter/hour) and preferably approximately 0.5 to approximately 4 $h^{-1}$. The temperature of the joint reactions of alkylation and dimerization is usually approximately 30° C. to approximately 350° C., often approximately 50° C. to approximately 250° C., and most often approximately 50° C. to approximately 220° C. and depends in general on the type of catalyst and/or the strength of the acidity of the catalyst by way of example, for an ion-exchange-type organic acid resin, the temperature is approximately 50° C. to approximately 150° C., preferably approximately 50° C. to approximately 120° C.

The pressure is chosen such that the charge is in liquid form in the temperature and pressure conditions. Said pressure is thus usually greater than 0.5 MPa. The effluents originating from unit A are conducted along line 3 to a distillation column or into any other separation unit B known to a person skilled in the art for allowing its separation into two fractions:

- a fraction (α) constituted by part of the C5 cut and unreacted olefins, which can be either partly or completely recycled to the entrance to unit A or used as gasoline base, evacuated through line 4.
- a fraction (β) the boiling points of which are compatible with the use of this cut as kerosene, i.e. for example the initial boiling temperature of which is at least 100° C., preferably at least 120° C. and very preferably at least 150° C., evacuated through line 5.

This cut (β) or kerosene cut can then be optionally hydrogenated in a unit C after mixing with a gas containing hydrogen and conducted along line 6. The aim of said hydrogenation is to eliminate any sulphur impurities and/or to considerably improve the smoke point of the kerosene produced. From unit C, the hydrogenated effluent is removed via line 7.

The following examples illustrate the present invention without limiting it. Examples 1 and 2 allow the reaction mechanisms employed on the model molecules to be understood and Examples 3 and 4 use a process each using a charge originating from a refinery process.

EXAMPLE 1

Reactions between Olefins having the same Number of Carbon Atoms

In this example, the charge is constituted by 169 g of heptane in which 3.6 g of cyclopentene and 4 g of methyl-2-butene-2 have been dissolved. The mixture is injected into a reactor containing 60 $cm^3$ of acid catalyst of sulphonic resin type. The mixture of the charge and the catalyst is heated to 100° C. The analyses by gas chromatography show that the methyl-2-butene-2 and the cyclopentene have completely disappeared and that three heavier products have appeared. The analyses by mass spectrometry allow the three products in the formulations to be identified:

- a product having a molecular mass of 136 g and an empirical formula $C_{10}H_{16}$ which can be identified as the product of the dimerization of cyclopentene,
- a product having a molecular mass of 138 g and an empirical formula $C_{10}H_{18}$ which can be identified as the product of the alkylation of cyclopentene by methyl-2-butene-2 and
- a product having a molecular mass of 140 g and an empirical formula $C_{10}H_{20}$ which can be identified as the product of the dimerization of methyl-2-butene-2.

EXAMPLE 2

Reactions with Olefins of Different Lengths

The protocol followed in this example is identical to that of the previous example. The charge is constituted by 136 g of heptane, 2.9 g of cyclopentene and 2.8 g of methyl-3-heptene-2. The reaction temperature is fixed at 100° C. The cyclopentene and methyl-3-heptene-2 disappear. As previously, three heavier compounds appear, the mass spectrometry of which allows the identification of:

- a product having a molecular mass of 136 g and an empirical formula $C_{10}H_{16}$ which can be identified as the product of the dimerization of cyclopentene,
- a product having a molecular mass of 180 g and an empirical formula $C_{13}H_{24}$ which can be identified as the product of the alkylation of methyl-3-heptene-2 on cyclopentene and
- a product having a molecular mass of 224 g and an empirical formula $C_{16}H_{32}$ which can be identified as the product of the dimerization of methyl-3-heptene-2.

EXAMPLE 3

Reaction on Real Charges (Comparison)

A C5 cut originating from the distillation of a gasoline from a steam-cracking unit is used in this example. This C5 cut has undergone a preliminary step of selective hydrogenation of diolefins.

It is constituted by 70% by weight of olefins 25% of which is cyclopentene and 23% by weight is methyl butenes. The distillation range of this charge is between −6° C. and 55° C.

Said cut is passed to an acid catalyst of Nafion® type sold by DuPont de Nemours. This catalyst is a mixture of silica and Nafion NR50®, Nafion NR50® being a perfluorocarboxylated copolymer having $SO_3H$ sulphonic groups. The pressure prevailing in the unit is 1.2 MPa, the reaction temperature is equal to 100° C. and the volume velocity per hour (VVH) is fixed at 0.5 liters/liter of catalyst/hour. The effluent at the outlet of the unit is passed into a distillation column in order to separate two cuts:

- a light gasoline cut the upper distillation point of which is less than 100° C., with a yield of 88% by weight and
- a kerosene cut having a distillation range between 100° C. and 250° C. with a yield of 12% by weight.

The smoke point of this cut, measured according to the ASTM standard D1322, is 15 mm.

EXAMPLE 4

Reaction on Real Charges (According to the Invention)

The same C5 cut as used in Example 3 was mixed in equal weight with a C8 cut originating from the process of dimerization/oligomerization of butenes described in the patent FR-B-2 765 573. This cut is constituted 60% by weight by methyl-heptene and 35% by weight by dimethylheptene.

The mixture is passed into the same unit as previously where the alkylation and dimerization reactions occur in the same operating conditions as previously in the presence of the same catalyst. The effluent at the outlet of the unit is passed into a distillation column where it is distilled into two cuts:

- a light gasoline cut the upper distillation point of which is less than 100° C., with a yield of 20% by weight and
- a kerosene cut having a distillation range between 100° C. and 250° C. with a yield of 80% by weight.

The smoke point of this cut, measured according to the ASTM standard D1322, is 25 mm.

EXAMPLE 5

Hydrogenation of the Kerosene Cut

The kerosenes originating from Examples 3 and 4 are hydrogenated on a palladium-based catalyst deposited on charcoal. This hydrogenation was carried out at VVH=1 1/1/h, a temperature of 150° C. and a pressure of 5 MPa. This hydrogenation does not change the kerosene yields, but allows their smoke point to be improved, measured according to the ASTM standard D1322:

Example 3: the smoke point rises from 15 mm to 28 mm

Example 4: the smoke point rises from 25 mm to 42 mm

The process according to the invention thus allows the valorization of light gasoline cuts, mostly producing from said cuts a synthetic kerosene with a high smoke point, i.e. much greater than the current specifications.

The preceding examples can be repeated with similar success by substituting the generically or specifically described reactants and/or operating conditions of this invention for those used in the preceding examples.

The entire disclosure of all applications, patents and publications, cited herein and of corresponding French Application No. 02/10951, filed Sep. 4, 2002, are incorporated by reference herein.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for the valorization of a liquid charge of hydrocarbons and for reducing the vapor pressure of said charge comprising the following steps:

a) the separation from said charge of hydrocarbons of a fraction (O1) at least 30% by weight of compounds containing 5 carbon atoms, including at least 2% by weight of pentenes, b) a placing of said fraction (O1) in contact with a cut of hydrocarbons (O2) at least partly comprising hydrocarbons having a number of carbon atoms between 6 and 10, including at least 2% by weight of olefins, in the presence of at least one catalyst promoting the reactions of dimerization and alkylation of at least a portion of resultant hydrocarbons present in the mixture originating from said placing in contact.

c) a separation of the effluents originating from step b) into at least two cuts:

a gasoline cut (α) the upper distillation point of which is less than 100° C. and comprising most of the hydrocarbons that have not reacted and a kerosene cut (β) having a distillation range between 100° C. and 300° C. comprising most of the resultant products originating from the alkylation and dimerization reactions.

2. A process according to claim 1 further comprising in addition a step d) comprising of hydrogenating the unsaturated compounds contained in the kerosene cut (β) originating from step c).

3. A process according to claim 1 wherein said liquid charge of hydrocarbons is a gasoline cut originating from a steam-cracking, catalytic cracking (FCC) or coking process.

4. A process according to claim 1 wherein said cut of hydrocarbons (O2) originates from a refinery process chosen from the group constituted by catalytic cracking (FCC), oligomerization of ethylene, dehydrogenation of paraffins, dimerization and/or oligomerization of butenes and propenes.

5. A process according to claim 1 in which said fraction (O1) comprises at least 70% by weight of compounds containing 5 carbon atoms.

6. A process according to claim 5 wherein said fraction (O1) comprises at least 10% by weight of pentenes.

7. A process according to claim 1 wherein said cut of hydrocarbons (O2) comprises at least 30% by weight of hydrocarbons containing from 6 to 10 carbon atoms.

8. A process according to claim 7 wherein said cut of hydrocarbons (O2) comprises at least 30% by weight of olefins.

9. A process according to claim 8 wherein said cut of hydrocarbons (O2) is constituted by a pure olefin or a mixture of pure olefins.

10. A process according to claim 1 wherein said catalyst of the reactions of dimerization and alkylation of olefins is an acid catalyst.

11. A process according to claim 10 in which said catalyst is chosen from the group consisting of ion exchange resins, silica-aluminas, zeolites, clays, supported sulphuric acid and supported phosphoric acid.

12. A process according to claim 1 wherein steps b) and c) are carried out simultaneously.

13. A process according to claim 1 wherein at least one fraction of at least one gasoline cut originating from step c) at least partly constitutes the cut of hydrocarbons (O2) of step b) of placing in contact.

14. A process according to claim 1 further comprising providing the gasoline cuts originating from step c) as a gasoline base.

15. A process according to claim 7 in which said fraction (O1) comprises at least 70% by weight of compounds containing 5 carbon atoms.

16. A process according to claim 8 in which said fraction (O1) comprises at least 70% by weight of compounds containing 5 carbon atoms.

17. A process according to claim 9 in which said fraction (O1) comprises at least 70% by weight of compounds containing 5 carbon atoms.

18. A process according to claim 16 wherein fraction 01 comprises at least 90% by weight of C5 hydrocarbon.

19. A process according to claim 16 wherein fraction 01 comprises at least 95% by weight of C5 hydrocarbon.

20. A process according to claim 16 wherein fraction 01 comprises at least 99% by weight of C5 hydrocarbon.

* * * * *

UNITED STATES PATENT AND TRADEMARK OFFICE

CERTIFICATE OF CORRECTION

PATENT NO. : 7,161,052 B2
APPLICATION NO. : 10/653426
DATED : January 9, 2007
INVENTOR(S) : Patrick Briot It is certified that error appears in the above-identified patent and that said Letters Patent is hereby corrected as shown below:

On the Title page, Item [75] Inventors: line 5, reads "Lyons" should read -- Lyon --

Signed and Sealed this

Eighteenth Day of March, 2008

JON W. DUDAS
*Director of the United States Patent and Trademark Office*